US010544962B2

(12) United States Patent
Caves et al.

(10) Patent No.: US 10,544,962 B2
(45) Date of Patent: Jan. 28, 2020

(54) WATER HEATER AND METHOD OF OPERATING THE SAME

(71) Applicant: AOS HOLDING COMPANY, Wilmington, DE (US)

(72) Inventors: Andrew Robert Caves, Hartsville, SC (US); Andrew William Phillips, Columbia, SC (US); Brian Thomas Branecky, Oconomowoc, WI (US); William Louis Mehlhorn, Menomonee Falls, WI (US); Thomas G. Van Sistine, Hartsville, SC (US); Robert Eugene Olson, Milton, WA (US); Zhongsheng Niu, Columbia, SC (US)

(73) Assignee: AOS HOLDING COMPANY, Wilmington, DE (US)

( * ) Notice: Subject to any disclaimer, the term of this patent is extended or adjusted under 35 U.S.C. 154(b) by 776 days.

(21) Appl. No.: 15/233,327

(22) Filed: Aug. 10, 2016

(65) Prior Publication Data

US 2016/0348944 A1 Dec. 1, 2016

Related U.S. Application Data

(63) Continuation of application No. 12/338,355, filed on Dec. 18, 2008, now Pat. No. 9,435,565.

(51) Int. Cl.
*F24H 9/20* (2006.01)
*F24H 1/20* (2006.01)

(52) U.S. Cl.
CPC ..... *F24H 9/2021* (2013.01); *F24H 1/202* (2013.01)

(58) Field of Classification Search
CPC .... F24C 7/082; F24C 15/106; G05D 23/1917
(Continued)

(56) References Cited

U.S. PATENT DOCUMENTS 3,586,869 A 6/1971 Kompelien et al.
3,770,977 A 11/1973 McIntosh
(Continued)

FOREIGN PATENT DOCUMENTS

CA 1291785 11/1991
CA 1298865 4/1992
WO 2005/045327 5/2005

OTHER PUBLICATIONS

Canadian Patent Office Action for Application No. 2688664 dated Jan. 13, 2012 (4 pages).
(Continued)

*Primary Examiner* — Tu B Hoang
*Assistant Examiner* — Thomas J Ward
(74) *Attorney, Agent, or Firm* — Michael Best Friedrich LLP

(57) ABSTRACT

A storage-type water heater including a tank for supporting water to be heated, a first heating element, a first relay connected to the first heating element, a second heating element, a second relay connected to the second heating element, and a controller for selectively operating the first relay and the second relay. The controller includes instructions for selecting a mode from at least, a no-sequencing mode, wherein the first relay and the second relay are operated concurrently, and a sequencing mode, wherein the first relay and the second relay are operated sequentially. The controller also operates the first relay to supply power to the first heating element, and operates the second relay to supply power to the second heating element, based on the selected mode.

18 Claims, 8 Drawing Sheets

(58) Field of Classification Search
USPC ..... 219/483–486, 507, 508, 494, 438, 441, 219/442; 165/240–241; 392/479, 480, 392/489
See application file for complete search history.

(56) References Cited

U.S. PATENT DOCUMENTS

| | | | | |
|---|---|---|---|---|
| 3,787,729 | A | 1/1974 | Bennett | |
| 4,289,954 | A | 9/1981 | Brognano et al. | |
| 4,333,002 | A | 6/1982 | Kozak | |
| 4,476,028 | A | 10/1984 | Harris | |
| 4,511,790 | A | 4/1985 | Kozak | |
| 4,588,875 | A | 5/1986 | Kozak et al. | |
| 4,638,147 | A | 1/1987 | Dytch et al. | |
| 5,280,422 | A | 1/1994 | Moe et al. | |
| 5,367,602 | A | 11/1994 | Stewart | |
| 5,866,880 | A | 2/1999 | Steitz et al. | |
| 5,949,960 | A | 9/1999 | Hall | |
| 5,968,393 | A * | 10/1999 | Demaline ..... | G05D 23/1904 219/485 |
| 6,080,971 | A | 6/2000 | Seitz et al. | |
| 6,080,973 | A | 6/2000 | Thweatt, Jr. | |
| 6,137,955 | A | 10/2000 | Krell et al. | |
| 6,242,720 | B1 | 6/2001 | Wilson et al. | |
| 6,271,505 | B1 * | 8/2001 | Henderson ..... | F24H 9/2021 219/483 |
| 6,363,216 | B1 | 3/2002 | Brandenbaugh | |
| 6,795,644 | B2 | 9/2004 | Bradenbaugh | |
| 7,103,272 | B2 | 9/2006 | Baxter | |
| 7,164,851 | B2 | 1/2007 | Sturm et al. | |
| 7,256,372 | B2 | 8/2007 | Knoeppel et al. | |
| 7,372,005 | B2 | 5/2008 | Knoeppel et al. | |
| 2002/0125241 | A1 | 9/2002 | Scott | |
| 2006/0013572 | A1 * | 1/2006 | Phillips ..... | F24H 9/2021 392/459 |
| 2007/0177858 | A1 | 8/2007 | Knoeppel et al. | |

OTHER PUBLICATIONS

Canadian Patent Office Action for Application No. 2688664 dated Nov. 27, 2012 (2 pages).

* cited by examiner

WATER HEATER AND METHOD OF OPERATING THE SAME

RELATED APPLICATIONS

This application is a continuation of and claims priority to U.S. patent application Ser. No. 12/338,355 entitled "WATER HEATER AND METHOD OF OPERATING THE SAME" filed Dec. 18, 2008, the entire contents of which are incorporated by reference.

FIELD OF INVENTION

The invention relates to electric water heaters.

SUMMARY

In one embodiment, the invention provides a storage-type water heater including a tank for supporting water to be heated; a first heating bank including a first heating surface disposed within the tank; a first contactor connected to the first heating bank; a second heating bank including a second heating surface disposed within the tank; a second contactor connected to the second heating bank; and a controller for selectively operating the first contactor and the second contactor, the controller including instructions for, in one power cycle, operating the first contactor to supply power to the first heating bank, and while supplying power to the first heating bank, operating the second contactor to supply power to the second heating bank.

In another embodiment, the invention provides a method for operating a storage-type water heater including a first heating bank including a first heating surface disposed within the tank, a first contactor connected to the first heating bank, a second heating bank including a second heating surface disposed within the tank, a second contactor connected to the second heating bank, and a controller for selectively operating the first contactor and the second contactor, the method comprising: operating the first contactor to supply power to the first heating bank; thereafter operating the second contactor to supply power to the second heating bank; thereafter operating one of the first contactor and the second contactor to stop supply power to the corresponding heating bank; and thereafter operating the other of the first contactor and the second contactor to stop supply power to the corresponding heating bank.

In another embodiment, the invention provides a storage-type water heater including a tank for supporting water to be heated; a first heating bank including a first heating surface disposed within the tank; a first contactor connected to the first heating bank; a second heating bank including a second heating surface disposed within the tank; a second contactor connected to the second heating bank; and a controller for selectively operating the first contactor and the second contactor, the controller including instructions for operating one of the first contactor and the second contactor to stop supply power to the corresponding heating bank, and operating the other of the first contactor and the second contactor to stop supply power to the corresponding heating bank.

In another embodiment, the invention provides a storage-type water heater including a tank for supporting water to be heated; a first heating bank including a first heating surface disposed within the tank; a first contactor connected to the first heating bank; a second heating bank including a second heating surface disposed within the tank; a second contactor connected to the second heating bank; a temperature probe disposed within the tank for generating a signal having a relation to the temperature of the water in the tank; and a controller for selectively operating the first contactor and the second contactor based on the signal, the controller including instructions for, in a first sequence, operating the first contactor to supply power to the first heating bank as a result of the value of the signal being less than a first threshold value, and operating the second contactor to supply power to the second heating bank as a result of the value of the signal being less than a second threshold value, the first threshold value being greater than the second threshold value, and, in a second sequence, operating one of the first contactor and the second contactor to stop supply power to the corresponding heating bank as a result of the value of the signal being greater than a third threshold value, and operating the other of the first contactor and the second contactor to stop supply power to the corresponding heating bank as a result of the value of the signal being greater than a fourth threshold value, the fourth threshold value being greater than the third threshold value.

In another embodiment, the invention provides a storage-type water heater including a tank for supporting water to be heated, a first heating element, a first relay connected to the first heating element, a second heating element, a second relay connected to the second heating element, and a controller for selectively operating the first relay and the second relay. The controller includes instructions for selecting a mode from at least, a no-sequencing mode, wherein the first relay and the second relay are operated concurrently, and a sequencing mode, wherein the first relay and the second relay are operated sequentially. The controller also operates the first relay to supply power to the first heating element, and operates the second relay to supply power to the second heating element, based on the selected mode.

In another embodiment, the invention provides a method for operating a water heater, the method comprising receiving, at a controller, a selection between at least one selected from the group consisting of a no-sequencing mode, wherein a first relay and a second relay are operated concurrently, and a sequencing mode, wherein the first relay and the second relay are operated sequentially, and operating, via the controller, the first relay to supply power to a first heating element, and operating the second relay to supply power to a second heating element, basing the operation on the selected mode.

In another embodiment, the invention provides a storage-type water heater including a tank for supporting water to be heated, a first heating element, a first relay connected to the first heating element, a second heating element, a second relay connected to the second heating element, and a controller for selectively operating the first relay and the second relay. The controller includes instructions for selecting a mode from at least, a no-sequencing mode, wherein the first and second relays are operated to supply power to the first and second heating elements concurrently, a linear sequencing mode, wherein in one heating cycle, the first relay is operated to supply power to the first heating element, while operating the first relay the second relay is operated to supply power to the second heating element, then while supplying power to the second heating element operating the first relay to stop supply power to the first heating element while power is still supplied to the second heating element, and a progressive sequencing mode, wherein in one heating cycle, the first relay is operated to supply power to the first heating element, while operating the first relay the second relay is operated to supply power to the second heating element, then while supplying power to the first heating element operating the second relay to stop supply power to the second heating element while power is still supplied to the first heating element. The controller also operates the first relay to supply power to the first heating element, and operates the second relay to supply power to the second heating element, basing the operation on the selected mode.

A storage-type water heater including a tank for supporting water to be heated, a first heating element, a first relay connected to the first heating element, a second heating element, a second relay connected to the second heating element, a temperature probe disposed within the tank for generating a signal having a relation to the temperature of the water in the tank, and a controller for selectively operating the first relay and the second relay based on the signal. The controller includes instructions for selecting an operation based on at least the following modes, a no-sequencing mode, wherein the first and second relays are operated to supply power to the first and second heating elements concurrently, a linear sequencing mode, wherein, in one heating cycle, the first relay to supply power to the first heating element as a result of the value of the signal being less than a first threshold value, the second relay to supply power to the second heating element as a result of the value of the signal being less than a second threshold value, the first threshold value being greater than the second threshold value, the first relay stopping supply power to the first heating element as a result of the value of the signal being greater than a third threshold value, and the second relay stopping supply power to the second heating element as a result of the value of the signal being greater than a fourth threshold value, the fourth threshold value being greater than the third threshold value, and a progressive sequencing mode, wherein, in one heating cycle, the first relay to supply power to the first heating element as a result of the value of the signal being less than a first threshold value, the second relay to supply power to the second heating element as a result of the value of the signal being less than a second threshold value, the first threshold value being greater than the second threshold value, the second relay stopping supply power to the second heating element as a result of the value of the signal being greater than a third threshold value, and the first relay stopping supply power to the first heating element as a result of the value of the signal being greater than a fourth threshold value, the fourth threshold value being greater than the third threshold value. The controller also operates the first relay to supply power to the first heating element, and operates the second relay to supply power to the second heating element, basing the operation on the selected mode.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
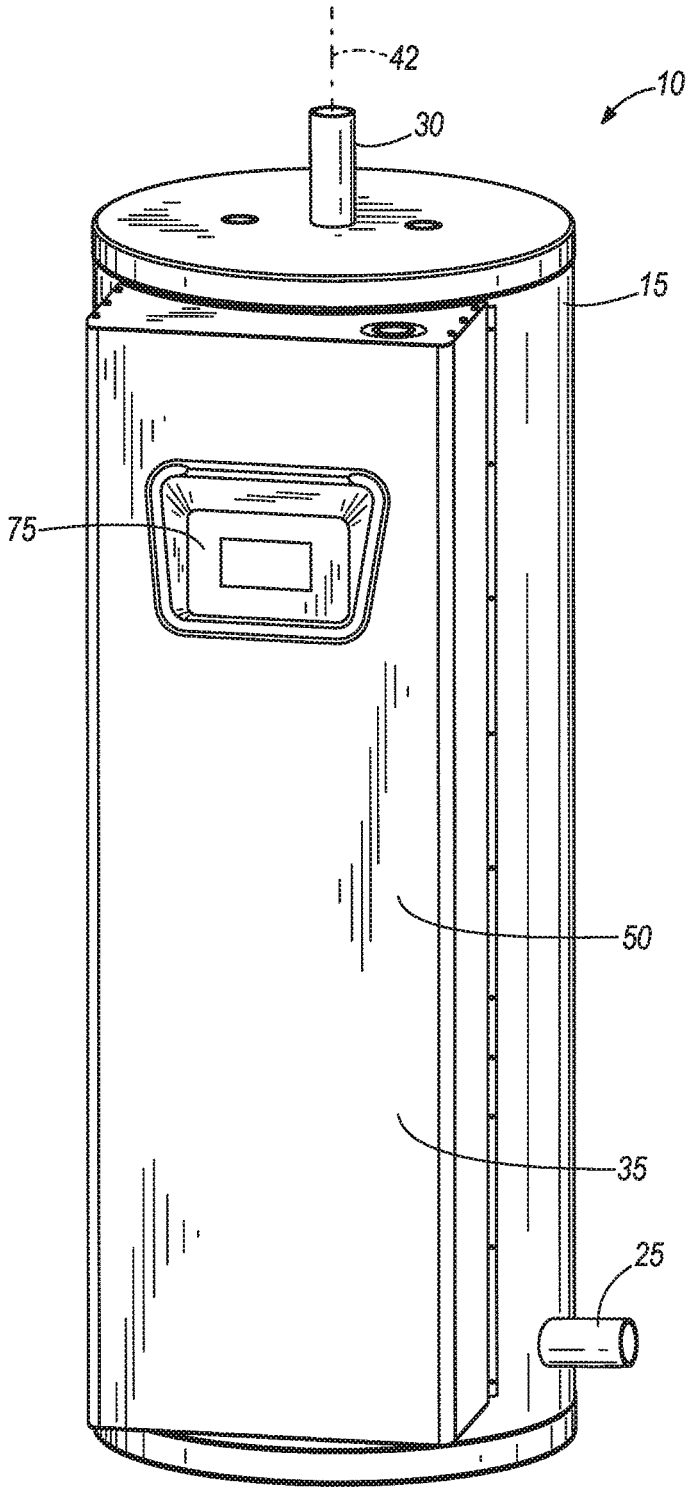
FIG. 1 is a perspective view of a water heater incorporating one embodiment of the invention.
Figure 2:
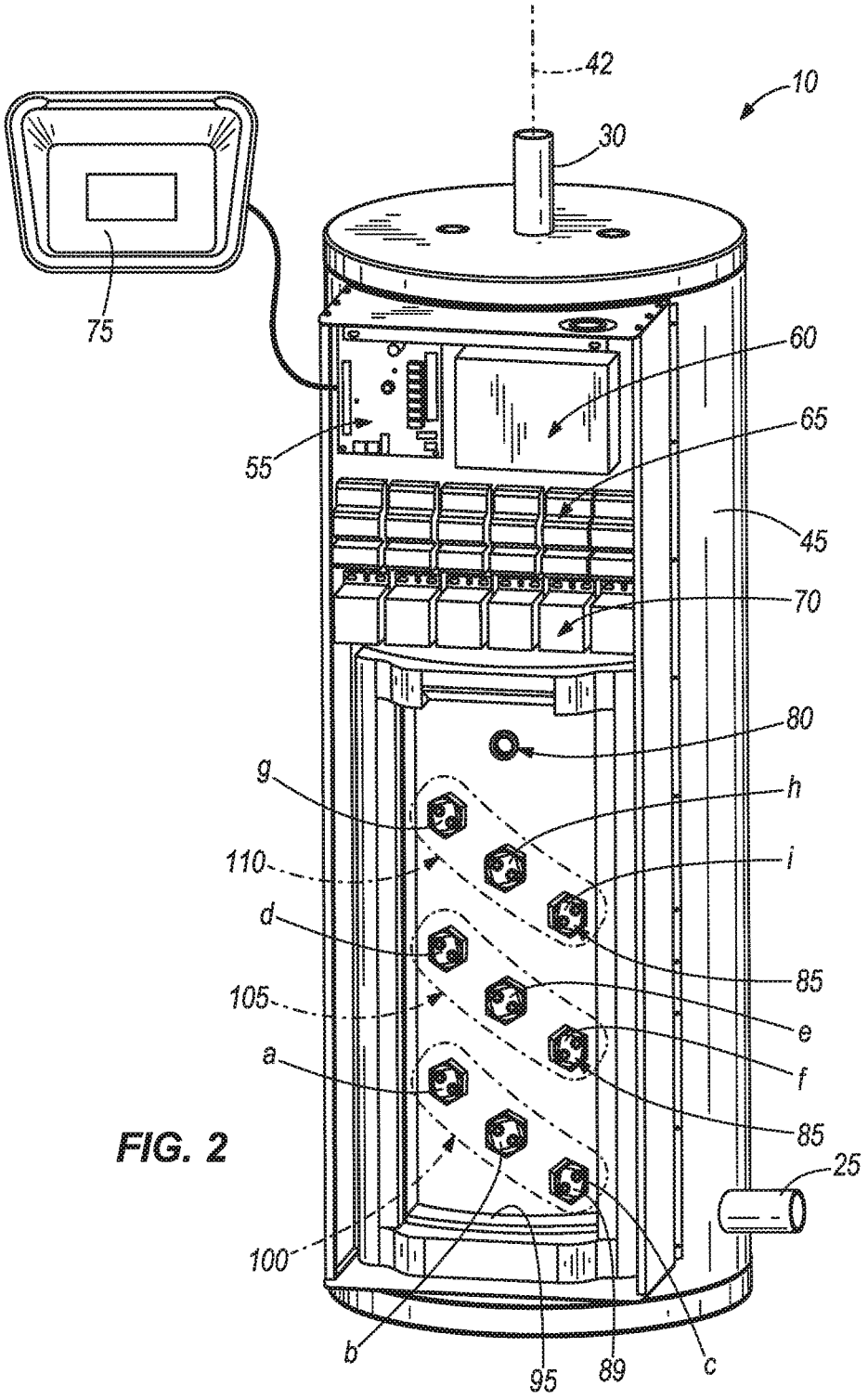
FIG. 2 is another perspective view of the water heater in FIG. 1 with a door removed.
Figure 3:
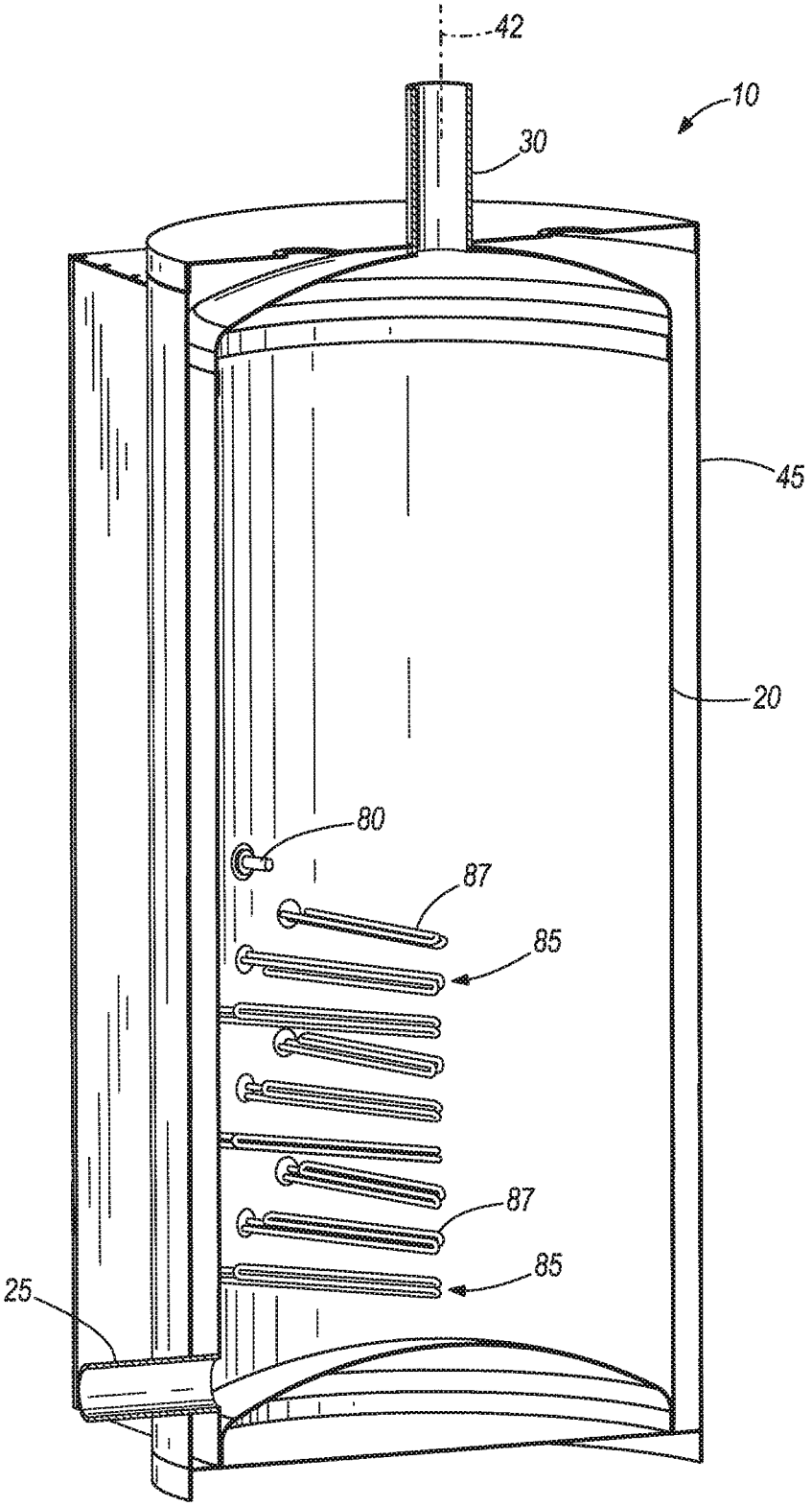
FIG. 3 is a cut section view of the water heater in FIG. 1 illustrating heating elements of the water heater.

FIGS. 1-5 illustrate a water heater 10 incorporating one embodiment of the invention. The water heater 10 is a storage-type water heater and includes a substantially cylindrical outer shell 15 substantially aligned with a central axis 42, a water tank 20 within the outer shell 15, a water inlet 25 located at the lower portion of the water heater 10, a water outlet 30 located at the upper portion of the water heater 10, and a control box 35 for enclosing control and power circuitry of the water heater 10 (further described below). In the illustrated construction, the outer shell 15 and the tank 20 form a space 40 there between (FIG. 3). Foam or other insulating material is placed within the space 40 for thermally insulating the tank 20. It is to be understood that the water heater 10 is described herein for illustration purposes only and other configurations of the water heater 10 fall within the scope of the invention.

In the illustrated construction, the control box 35 is mounted on a side wall 45 of the outer shell 15. The control box 35 includes a door 50 and encloses a central control board (CCB) 55, power circuitry 60, a number of fuses 65, and a number of contactors 70. A user interface module (UIM) 75 is mounted on the door 50 of the control box 35. However, in other constructions, the UIM 75 can also be enclosed within the control box 35. The control box 35 also provides access to a temperature probe 80 and a number of heating elements 85 mounted on the wall of the tank 20. Particularly, the control box 35 encloses an access portion 90 of the water heater 10 including a wall 95 extending between the outer shell 15 and the tank 20. Among other things, the access portion 90 provides access to a portion of the water tank 20 to install, maintain, and operate elements mounted on the tank 20. Such elements include, but are not limited to, the temperature probe 80 and heating elements 85.

As further explain below, the CCB 55 is utilized to control the contactors 70 that, in turn, relay power from the power circuitry 60 to the heating elements 85. Particularly, the CCB 55 controls the contactors 70 based upon, among other things, a signal from the temperature probe 80. The fuses 65 are connected between the power circuitry 60 and the contactors 70 to regulate the power supply to the contactors 70 and heating elements 85. Further, a user or manufacturer can program, customize settings, and operate the water heater 10 via the UIM 75.

As illustrated in FIGS. 2 and 3, the water heater 10 includes nine heating elements 85*a*, 85*b*, 85*c*, 85*d*, 85*e*, 85*f*, 85*g*, 85*h*, and 85*i*. Each heating element 85 is defined as a single loop heating element. Each element 85 includes a resistive portion or surface 87 (FIG. 3) for heating water and a mounting portion 89 (FIG. 2) for connecting the heating element 85 to the tank 20.

The heating elements 85 are mounted on the tank 20 forming three heating banks 100, 105, and 110. Each heating bank 100, 105, and 110 includes three heating elements 85. More specifically, heating elements 85*a*, 85*b*, and 85*c* form the first heating bank 100, heating elements 85*d*, 85*e*, and 85*f* form the second heating bank 105, and heating elements 85*g*, 85*h*, and 85*i* form the third heating bank 110. As further explained below, power is supplied to the heating elements 85 of each heating bank 100, 105, and 110 simultaneously. In the illustrated construction, each heating bank 100, 105, and 110 is characterized by the heating elements 85 being arranged diagonally with respect to one another. Further, the second heating bank 105 is above the first heating bank 100, and the third heating bank 110 is above the second heating bank 105 with respect to the axis 42. Other constructions of the water heater 10 can include a different number and/or a different arrangement of heating elements 85.

Figure 4:
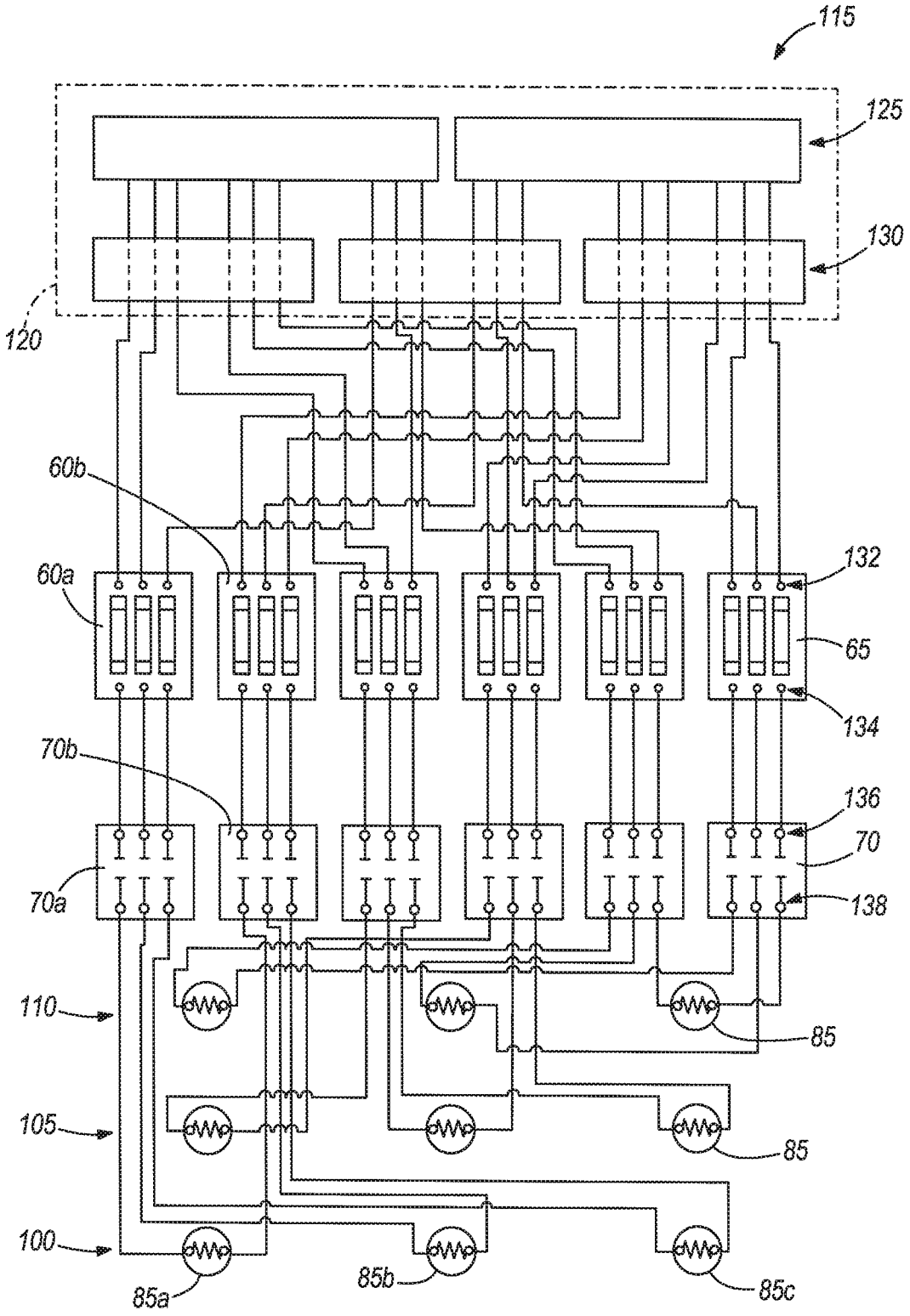
FIG. 4 is a wiring diagram of the water heater in FIG. 1.

FIG. 4 is a wiring diagram 115 illustrating some components of the water heater 10. More specifically, the wiring diagram 115 illustrates a terminal block 120 for receiving power from a power source (not shown); six fuses 65 connected to the terminal block 120 to help regulate the power from the terminal block 120 to the contactors 70; six contactors 70, each contactor 70 being connected to one fuse 65; and the heating elements 85 forming heating banks 100, 105, and 110. Each fuse 65 includes a first set of three terminals 132 for connecting the fuse 65 to the terminal block 120, and a second set of three terminals 134 for connecting the fuse 65 to one corresponding contactor 70. Each of the terminals of the first set 132 is connected to one terminal of the second set 134. Similarly, each contactor 70 includes a first set of three terminals 136 for connecting the contactor 70 to one corresponding fuse 65, and a second set of three terminals 138. Each terminal of the first set 136 is connected to one terminal of the second set 138. In turn, each terminal of the second set 138 is connected to one corresponding heating element 85 for delivering a current to or receiving a return current from the heating element 85.

In the illustrated construction, the water heater 10 is operable to receive power, via terminal block 120 of the power circuitry 60, from a single-phase electrical source or a three-phase electrical source. Based on the electrical source for providing power to the water heater 10, the terminal block 120 is configured or connected as a single-phase block 125 or a three-phase block 130. It is to be understood that the single-phase block 125 and the three-phase block 130 illustrated in FIG. 4 are only schematic illustrations of two wiring configurations of the terminal block 120 and do not represent separate or different elements.

For ease of description, the following refers specifically to the wiring configuration of the first heating bank 100. As illustrated in FIG. 4, the second heating bank 105 and the third heating bank 110 include similar configurations with respect to the configuration of the first heating bank 100, and thus, additional description is not necessary with respect to the second heating bank 105 and third heating bank 110. The terminal block 120 delivers current to the contactor 70*a* via fuse 65*a*. The contactor 70 a can selectively relay the current from the terminal block 120 to heating elements 85*a*, 85*b*, and 85*c* of the first heating bank 100. A return current from each of the heating elements 85 of the first heating bank 100 flows through contactor 70*b* and subsequently through fuse 65*b* to the terminal block 120. Operating contactors 70*a* and 70*b* deliver power to the heating elements 85 of the first heating bank 100 simultaneously. In other words, disabling one or both contactors 70*a* and 70*b* prevent power from being delivered to all heating elements 85 of the first heating bank 100. However, if one heating element 85*a*, 85*b*, or 85*c* of the first heating bank 100 becomes disabled or damaged, for example, power is still delivered via contactors 70*a* and 70*b* to the other two heating elements 85 of the first bank 100.

Figure 5:
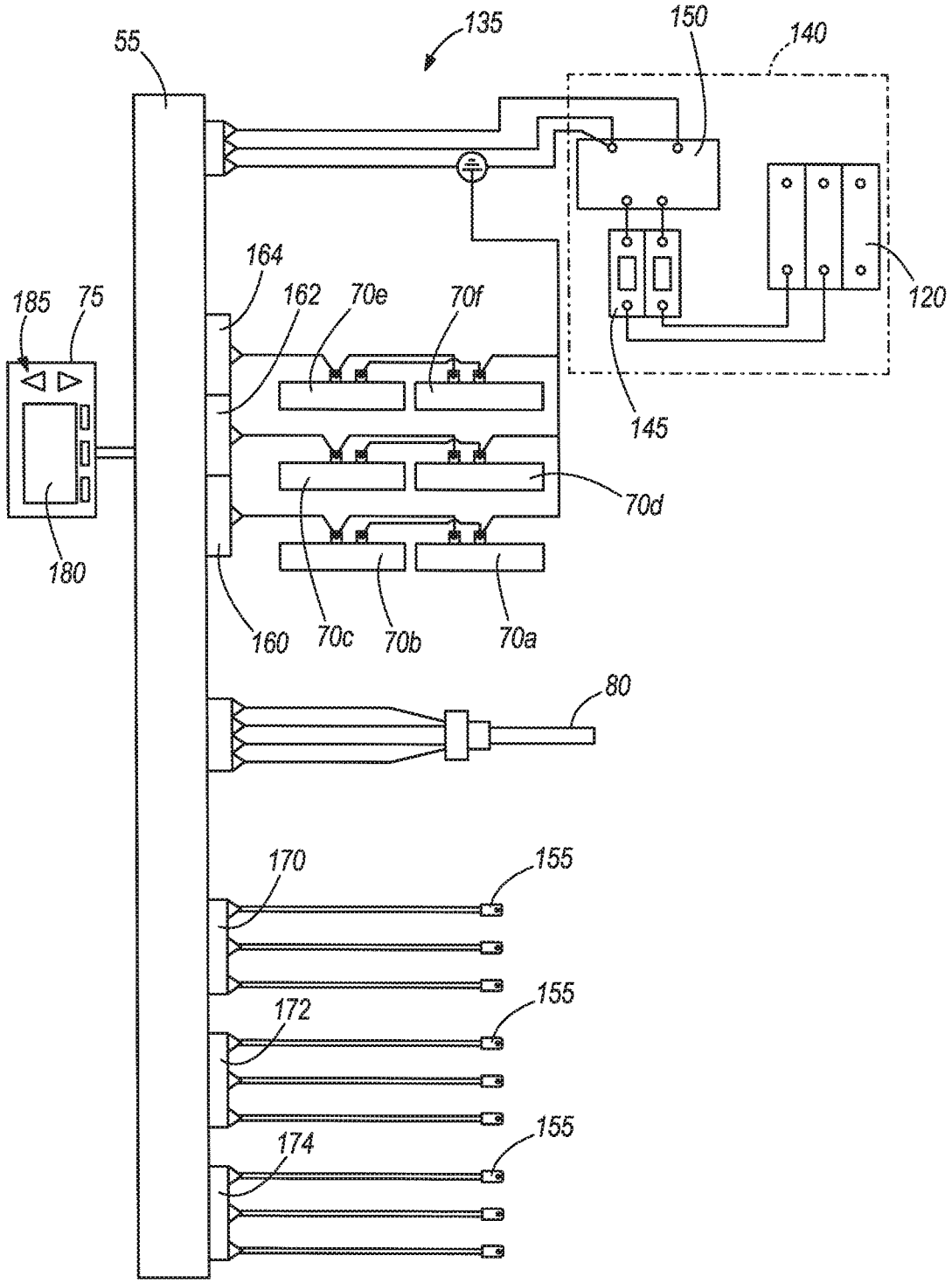
FIG. 5 is a schematic view of a control circuit of the water heater in FIG. 1.

FIG. 5 is a schematic view of a control circuit of the water heater 10 according to one embodiment of the invention. Particularly, FIG. 5 illustrates the UIM 75, temperature probe 80, contactors 70, nine element sensors 155, and a power source circuit 140 of the power circuitry 60 connected to the CCB 55. The power source circuit 140 includes the terminal block 120 delivering power to the CCB 55 via a controller fuse 145 and a transformer 150. In the illustrated construction, pairs of contactors 70 for relaying power to each of the heating banks 100, 105, and 110 (e.g., contactor 70*a* and 70*b*) are connected to the CCB 55 independently with respect to the other pairs of contactors 70. Particularly, contactors 70*a* and 70*b* operate the first heating bank 100 and are connected to the CCB 55 via an output contactor 160. Similarly, contactors 70*c* and 70*d* operate the second heating bank 105 and are connected to the CCB 55 via an output contactor 162, and contactors 70*e* and 70*f* operate the third heating bank 110 and are connected to the CCB 55 via an output contactor 164. Accordingly, the CCB 55 can selectively control the contactors 70 to relay power independently to each of the heating banks 100, 105, and 110.

The temperature probe 80 is directly connected to the CCB 55 to deliver a signal related to the temperature of the water in the tank 20. Further, the temperature probe 80 is associated with an energy cut off (ECO) switch (not shown) operable to help prevent water in the tank 20 from overheating. As further explained below with respect to the operation of the water heater 10, the ECO switch opens when the temperature probe 80 senses a temperature above a predetermined safe value. As a result, the CCB 55 controls the contactors 70 to interrupt current to the heating elements 85 and instructs the UIM 75 to display a fault message. Other constructions of the water heater 10 can include other sensors, probes, or sensing mechanisms connected to the CCB 55 for operating the water heater 10.

Although not shown, each of the element sensors 155 is connected to or is operable to detect the current through one corresponding heating element 85. As illustrated in FIG. 5, the element sensors 155 are connected to the CCB 55 in an arrangement based on the distribution of heating elements 85 in heating banks 100, 105, and 110. Particularly, the element sensors 155 associated with corresponding heating elements 85*a*, 85*b*, and 85*c* of the first heating bank 100 are connected to the CCB 55 via an input connector 170. Similarly, the element sensors 155 associated with corresponding heating elements 85*d*, 85*e*, and 85*f* of the second heating bank 105 are connected to the CCB 55 via an input connector 172; and the element sensors 155 associated with corresponding heating elements 85*g*, 85*h*, and 85*i* of the third heating bank 110 are connected to the CCB 55 via an input connector 174. As further explained below with respect to the operation of the water heater 10, when an element sensor 155 detects that current is not flowing through the corresponding heating element 85, the CCB 55 instructs the UIM 75 to display a warning message. Operation of the water heater 10 is not interrupted as a result of the warning-generation event.

The UIM 75 includes a display system 180 for displaying messages, warnings, fault indicators, settings, and other information related to the operation of the water heater 10 and the CCB 55. The UIM 75 also includes other interface devices, such as buttons and/or dials 185, which in combination with the display system 180, allow a user or manufacturer to access and configure the CCB 55 for operating the water heater 10. For example, the CCB 55 can include, among other things, a controller with a memory (not shown) including settings and instructions for operating the water heater 10. The settings and instructions are accessible via the UIM 75 or other suitable means, such as a programming interface of the CCB 55 (not shown).

In the illustrated construction, the CCB 55 includes adjustable settings that allow the CCB 55 to operate the water heater 10 as shown in FIGS. 1-4 or to operate water heaters with different configurations. More specifically, the CCB 55 can include information related to various aspects of a water heater in the form of look-up tables or instructions. Accordingly, a user or manufacturer can select specific settings and information in the CCB 55 related to the water heater to be operated by the CCB 55. For example, the CCB 55 can include information such as capacity of the tank 20, number of heating banks (e.g., heating banks 100, 105, and 110), number of heating elements 85 per heating bank, temperature settings or thresholds (e.g., ECO safe temperature value, set point temperature, and bank temperature differential), operating settings (e.g., sequencing modes and bank rotation), and a list of enabled/disabled sensing mechanisms (e.g., temperature probe 80 and element sensors 155).

During manufacturing or installation of the water heater 10, a user or manufacturer can individually select the parameters and settings of the water heater 10 in the CCB 55 via the UIM 75. In some constructions, the CCB 55 can also include in memory a list of water heater model numbers, each model number being associated with a number of parameters and settings of a specific water heater. For example, a model number of the water heater 10 can be associated with parameters indicating, among other things, the water heater 10 including three heating banks, each heating bank having three heating elements. Accordingly, a user or manufacturer can simply select the model number, via the UMI 75, instead of selecting all the water heater parameters and settings individually.

With specific reference to the temperature settings or thresholds, such temperature settings allow operation of the water heater 10 based on the signal provided by the temperature probe 80 (shown in FIG. 5). Particularly, the ECO safe temperature value regulates at which temperature the ECO switch is operated, causing the CCB 55 to stop operation of the water heater 10 and the UIM 75 to display a fault indicator or message. For example, the ECO safe temperature can be 202° F./94° C. With respect to this particular example, the CCB 55 can include instructions to close the ECO switch when the signal of the ECO probe 80 indicates the temperature of the water is about 120° F./49° C. In other constructions, the ECO safe temperature can vary based on the application of the water heater 10 (e.g., household or industrial applications).

The set point temperature is a value provided as primary reference for the CCB to operate the water heater 10. In other words, the set point temperature helps determine or calculate the temperature of the water at which the CCB 55 selectively controls the contactors 70 to either relay or stop power to the corresponding heating elements 85. In one example, for a temperature set point of about 120° F./49° C., the CCB 55 can be operable to initiate heating of the water in the tank 20 when the temperature of the water is equal or less than the temperature set point minus a temperature differential, as further explained below. Similarly, the CCB 55 can be operable to stop heating of the water (i.e., operate contactor(s) 70 to stop power supply to the corresponding heating bank 100, 105, 110) when the temperature of the water is equal to the set point temperature. Based on the application of the water heater 10, the temperature set point can be reprogrammed by a user or manufacturer to be a value between about 90° F. and 194° F. In other constructions, the CCB 55 can include instructions to reprogram the set point temperature to a value within a different range of temperatures.

The bank temperature differential is a value designated to each heating bank 100, 105, and 110 for calculating a temperature of the water in the tank 20 at which each heating bank (e.g., heating banks 100, 105, and 110) is operated. More specifically, the set point temperature and the bank temperature differential of each heating bank 100, 105, and 110 are used to determine at which temperature the contactor 70 of each heating bank 100, 105, and 110 starts or stops relaying power to the corresponding heating bank 100, 105, and 110. In the illustrated construction, the temperature differential can be a value between about 1° F. and 20° F. However, in other constructions the CCB 55 can include instructions to reprogram the temperature differential to a value within a different range of temperatures.

The operating settings, such as sequencing modes and bank rotation, refer to the mode of operation of the contactors 70 and corresponding heating banks 100, 105, and 110. In the illustrated construction, the CCB 55 can include instructions to operate the heating banks 100, 105, and 110 based on three heating sequences: no sequencing, linear sequencing and progressive sequencing. In other constructions of the water heater 10, the CCB 55 can include instructions to operate the heating banks 100, 105 and 110 according to other heating sequences.

When operating the heating banks with the no-sequencing heating sequence, all heating banks (e.g., heating banks 100, 105 and 110) are energized concurrently to heat the water in the tank 20 during a heating cycle, and all heating banks are dienergized concurrently. For practicality purposes, there is a relatively small time delay (e.g., one second delay) when energizing the heating banks 100, 105, and 110, for reducing starting current requirements. When operating the heating banks with linear sequencing or progressive sequencing, in a heating cycle, the heating banks are energized sequentially based on the water temperate as calculated in the following formula:

$$T_{\#_ON} < T_{SETPOINT} - \sum_{i=1}^{\#} T_{i_DIFF}$$

where $T_{SETPOINT}$ is the set point temperature (e.g., 120° F.), # is the heating bank number (e.g., 1, 2 and 3 for heating banks 100, 105, and 110, respectively), and $T_{i_DIFF}$ is the temperature differential for each heating bank (e.g., T1_DIFF=3, T2_DIFF=3 and T3_DIFF=3).

Linear sequencing provides for the heating banks to be de-energized in a First-On-Last-Off sequence. The following formula particularly describes the sequence for de-energizing the heating banks 100, 105, and 110:

$$T_{\#_OFF} = T_{SETPOINT} - \sum_{i=1}^{(\#-1)} T_{i_DIFF}$$

while progressive sequencing provides for the heating banks to be de-energized in a First-On-First-Off sequence.

Further, when a user or manufacturer enables bank rotation during the manufacturing or installation of the water heater 10, heating banks 100, 105, and 110 are rotated during subsequent heating cycles to help ensure substantially equal or analogous use of the heating elements 85 of the heating banks 100, 105, and 110. For example, heating cycles of the water heater 10 operating the heating banks 100, 105, and 110 with linear sequencing and enabled bank rotation are as follows.

First heating cycle: banks are energized on [1, 2, 3] and de-energized on [3, 2, 1].

Second heating cycle: banks are energized on [2, 3, 1] and de-energized on [1, 3, 2].

Third heating cycle: banks are energized on [3, 1, 2] and de-energized on [2, 1, 3].

Fourth heating cycle: pattern repeats from the First heating cycle.

In another example, heating cycles of the water heater 10 operating the heating banks 100, 105 and 110 with progressive sequencing and enabled bank rotation are as follows.

First heating cycle: banks are energized on [1, 2, 3] and de-energized on [1, 2, 3].

Second heating cycle: banks are energized on [2, 3, 1] and de-energized on [2, 3, 1].

Third heating cycle: banks are energized on [3, 1, 2] and de-energized on [3, 1, 2].

Fourth heating cycle: pattern repeats from the First heating cycle.

Figure 6:
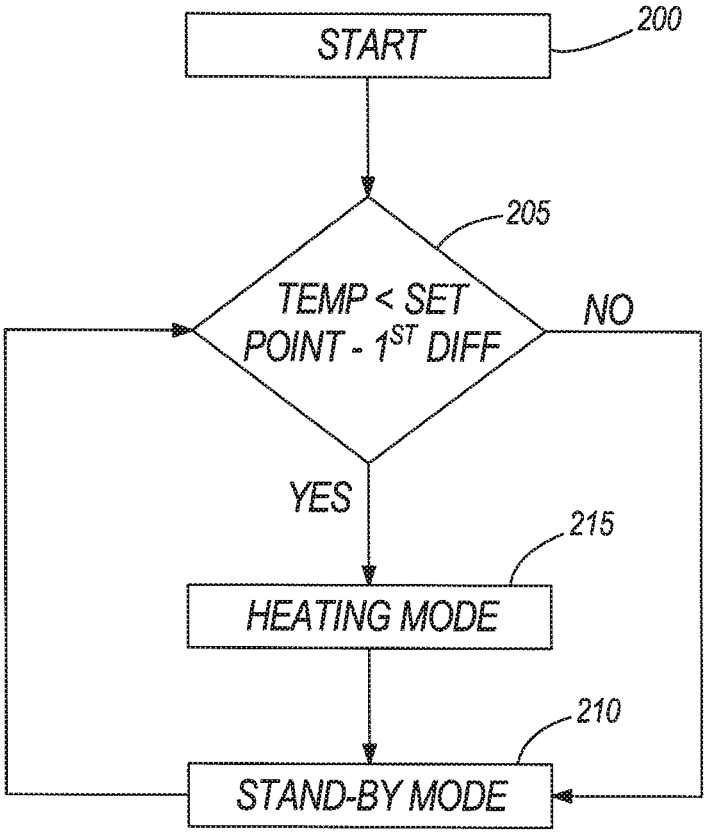
FIG. 6 is a flow diagram illustrating a method of operating the water heater in FIG. 1.

FIG. 6 is a flow diagram 200 illustrating a method of operating the water heater 10. The method of operating the water heater 10 is described herein under the assumption that temperature and operating settings have been previously selected. Operation of the water heater 10 initiates by powering the CCB 55 (Step 200). Particularly, a user can initiate operation of the water heater 10 by connecting the water heater 10 to a power source and subsequently actuating an ON/OFF button (not shown) of the UIM 75. The CCB 55 then compares the temperature of the water in the tank 20 to a value equal to the temperature set point minus one temperature differential (Step 205). If the temperature of the water in the tank 20 is above the value determined at step 205, the CCB 55 enters a stand-by or idle mode (Step 210). It is to be noted that the temperature of the water in the tank 20 is continuously monitored by the CCB 55 in all modes or stages of operation of the water heater 10.

If the temperature of the water in the tank 20 is below the value determined in step 205, the CCB 55 proceeds to a heating mode (Step 215) for heating the water in the tank 20. Particularly, the heating mode at step 215 is characterized by the CCB 55 operating the contactors 70 and heating banks 100, 105, and 110 to heat water in the tank 20 as described above with respect to the heating sequences. The water heater 10 remains in the heating mode at step 215 until the CCB 55 determines that water in the tank 20 has reached a temperature substantially equal or above the temperature set point. When the temperature of the water in the tank 20 is substantially equal or above the set point temperature, the CCB 55 proceeds to the stand-by mode 210.

In addition to the heating mode (at step 215) and the stand-by mode (at step 210), the CCB 55 can also operate the water heater 10 in a fault mode. More specifically, the CCB 55 can proceed to the fault mode at any instant during the operation of the water heater 10 as a result of the CCB 55 detecting a fault condition. For example, the temperature probe 80 detecting a temperature of the water in the tank 20 at or above the ECO safe temperature constitutes a fault condition. As a result of the fault condition, the ECO switch is actuated causing the CCB 55 to operate the contactors 70 to stop current to the heating banks 100, 105, and 110 and the UIM 75 to display a fault message (e.g., a message showing the temperature of the water in the tank 20). In the illustrated construction, to operate the water heater 10 subsequent to the fault state, the fault condition needs to subside and a user needs to manually reset or restart the water heater 10. In some cases, however, to operate the water heater 10 subsequent to the fault state, it may be sufficient for the fault condition to subside.

The CCB 55 is also operable to detect warning events generated by sensing mechanisms of the water heater 10. In the illustrated construction, the element sensor 155 detects the current flow through one corresponding heating element 85. If the element sensor 155 does not detect a current flow through the heating element 85, the CCB 55 operates the UIM 75 to display a warning message. For example, the UIM 75 may display a message indicating the heating element(s) 85 appear to be inactive. Unlike fault conditions, warning events do not cause the CCB 55 to stop operation of the water heater 10.

Figure 7:
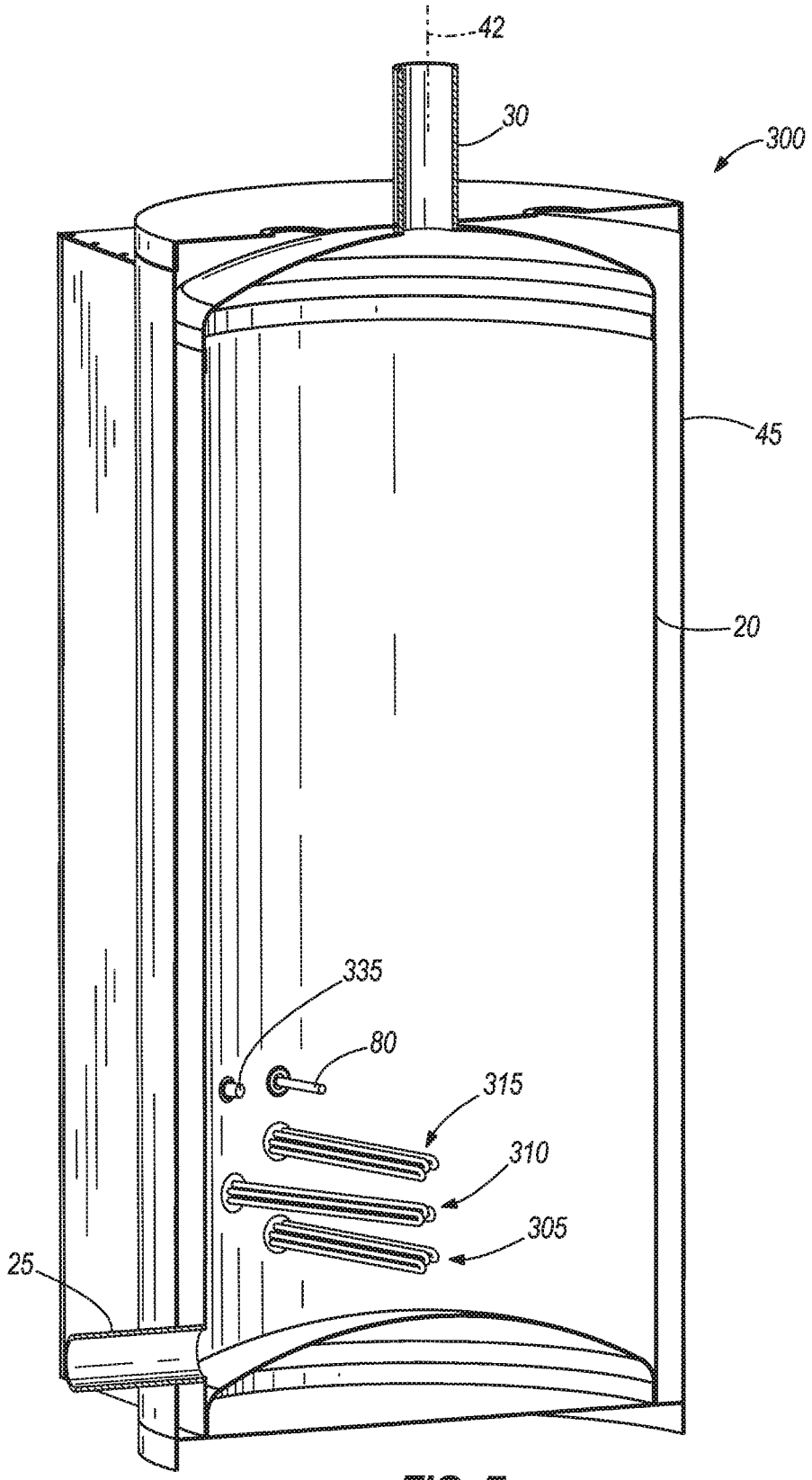
FIG. 7 is a cut section view of a water heater incorporating another embodiment of the invention.

FIGS. 7 and 8 illustrate a water heater 300 according to an alternative embodiment of the invention. The water heater 300 includes much of the same structure and has many of the same properties as the water heater 10 described above in connection with FIGS. 1-6, and common elements have the same reference numerals. The following description focuses primarily upon the structure and features that are different from the water heater 10. Particularly, the water heater 300 includes three heating banks 305, 310, and 315. Unlike the heating banks 100, 105, and 110 in water heater 10, each heating bank 305, 310, and 315 includes a first heating loop 320, a second heating loop 322, and a third heating loop 324 connected to one another as a single element 330.

Figure 8A:
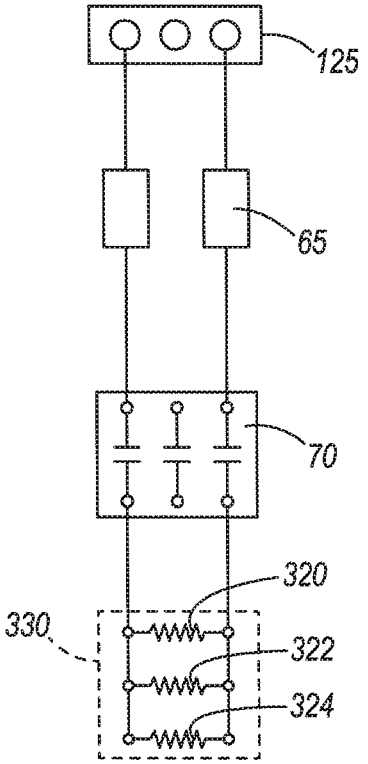
FIG. 8A is a partial wiring diagram of the water heater in FIG. 7.
Figure 8B:
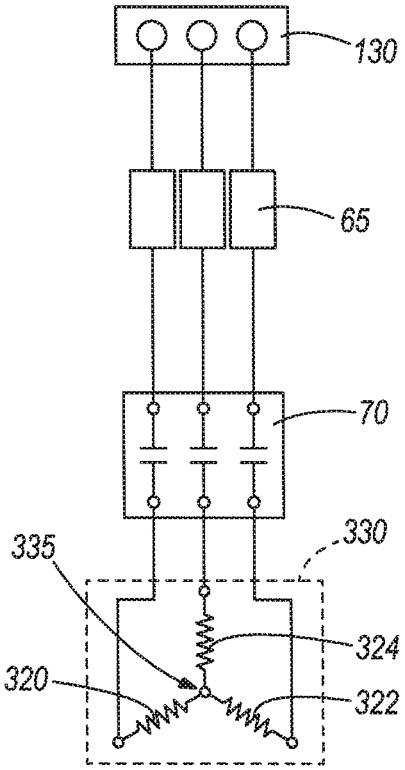
FIG. 8B is another partial wiring diagram of the water heater in FIG. 7.
Figure 8C:
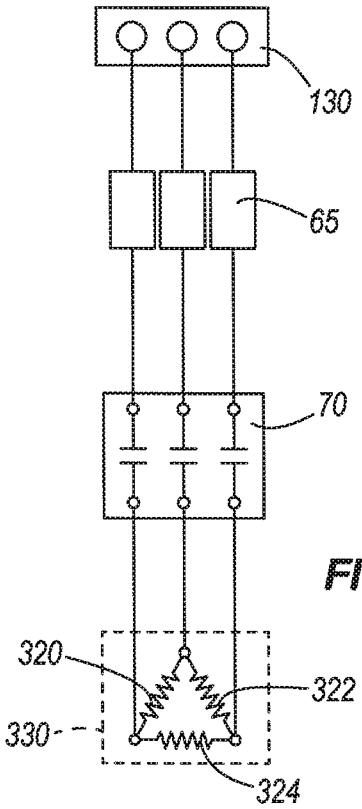
FIG. 8C is yet another partial wiring diagram of the water heater in FIG. 7.

FIGS. 8A, 8B, and 8C illustrate three alternate wiring configurations of the single element 330. FIG. 8A illustrates a single-phase terminal block 125 for supplying power to the single element 330. More specifically, terminal block 125 provides current to the single element 330 via two fuses 65 and one contactor 70. In the illustrated construction, the first heating loop 320, the second heating loop 322, and the third heating loop 324 are connected in a parallel configuration. FIG. 8B illustrates a three-phase terminal block 130 for supplying power to the single element 330. Terminal block 130 provides current to the single element 330 via three fuses 65 and one contactor 70. In the illustrated construction, the first heating loop 320, the second heating loop 322, and the third heating loop 324 are connected in a Y-configuration. More specifically, a first terminal of each of the first heating loop 320, the second heating loop 322, and the third heating loop 324 is connected to the contactor 70, and second terminals of the first heating loop 320, the second heating loop 322 and the third heating loop 324 are connected to one another as indicated by junction 335.

FIG. 8C illustrates a three-phase terminal block 130 for supplying power to the single element 330. Terminal block 130 provides current to the single element 330 via three fuses 65 and one contactor 70. In the illustrated construction, the first heating loop 320, the second heating loop 322, and the third heating loop 324 are connected in a Delta configuration. More specifically, the first heating loop 320, the second heating loop 322 and the third heating loop 324 form a triangular arrangement such that each corner of such triangular arrangement (the junction of two terminals) is connected to the contactor 70.

As illustrated in FIG. 7, the water heater 300 also includes a low water cut off (LWCO) probe 335 mounted on the tank 20 and connected to the CCB 55. The LWCO probe 335 provides a signal to the CCB 55 indicating that water within the tank 20 is at a level lower than a desirable or optimal level, thus creating a fault condition. In response to the signal generated by the LWCO probe 335, the CCB 55 enters the fault state and operates the contactors 70 to stop current to the heating banks 305, 310, and 315 and the UIM 75 to display a fault message or information related to the fault condition. To operate the water heater 300 subsequent to the fault state, water needs to be replenished within the tank 20 and a user needs to manually reset or restart the water heater 300.

Various features and advantages of the invention are set forth in the following claims.

What is claimed is:

1. A water heater comprising:

an apparatus for supporting a fluid;

a first heating element for manipulating a temperature of the fluid;

a first relay connected to the first heating element;

a second heating element for manipulating the temperature of the fluid;

a second relay connected to the second heating element;

a temperature probe for generating a signal relating the temperature of the fluid; and a controller for selectively operating the first relay and the second relay, the controller having an electronic circuit and including instructions for, selecting a mode from at least, a no-sequencing mode, wherein the first and second relays are operated to supply power to the first and second heating elements concurrently, and a linear sequencing mode, wherein in one heating cycle, the first relay to supply power to the first heating element as a result of the value of the signal being less than a first threshold value, the second relay to supply power to the second heating element as a result of the value of the signal being less than a second threshold value, the first threshold value being greater than the second threshold value, the first relay stopping supply power to the first heating element as a result of the value of the signal being greater than a third threshold value, and the second relay stopping supply power to the second heating element as a result of the value of the signal being greater than a fourth threshold value, the fourth threshold value being greater than the third threshold value, and operating the first relay to supply power to the first heating element, and operating the second relay to supply power to the second heating element, basing the operation on the selected mode.

2. The water heater of claim 1, wherein operating the first relay to supply power to the first heating element includes operating the first relay as a result of the value of the signal being less than a first threshold value, and wherein operating the second relay to supply power to the second heating element includes operating the second relay as a result of the value of the signal being less than a second threshold value, the first threshold value being greater than the second threshold value.

3. The water heater of claim 1, wherein the controller includes further instructions for, in the one power cycle, operating the first relay to stop supply power to the first heating element as a result of the value of the signal being greater than a first threshold value, and operating the second relay to stop supply power to the second heating element as a result of the value of the signal being greater than a second threshold value, the second threshold value being greater than the first threshold value.

4. The water heater of claim 1, wherein the first relay is a first contactor and the second relay is a second contactor.

5. The water heater of claim 1, wherein the controller further includes instructions for selecting a progressive sequencing mode wherein, in one heating cycle, the first relay to supply power to the first heating element as a result of the value of the signal being less than a first threshold value, the second relay to supply power to the second heating element as a result of the value of the signal being less than a second threshold value, the first threshold value being greater than the second threshold value, the second relay stopping supply power to the second heating element as a result of the value of the signal being greater than a third threshold value, and the first relay stopping supply power to the first heating element as a result of the value of the signal being greater than a fourth threshold value, the fourth threshold value being greater than the third threshold value.

6. The water heater of claim 1, wherein the controller further includes instructions for, in the one heating cycle, operating one of the first relay and the second relay to supply power to the corresponding heating element, and thereafter, operating the other of the first relay and the second relay to supply power to the corresponding heating element, and in another heating cycle subsequent to the one heating cycle, operating the other of the first contactor and a second contactor relay to supply power to the corresponding second heating element, and thereafter, operating the one of a first contactor relay and the second contactor to supply power to the corresponding first heating element.

7. A water heater comprising:

an apparatus for supporting a fluid;

a first heating element for manipulating a temperature of a fluid;

a first relay connected to the first heating element;

a second heating element for manipulating a temperature of a fluid;

a second relay connected to the second heating element;

a probe for generating a signal relating the temperature of the fluid; and a controller for selectively operating the first relay and the second relay, the controller having an electronic circuit and including instructions for, selecting a mode from at least, a no-sequencing mode, wherein the first and second relays are operated to supply power to the first and second heating elements concurrently, and a progressive sequencing mode wherein, in one heating cycle, the first relay to supply power to the first heating element as a result of the value of the signal being less than a first threshold value, the second relay to supply power to the second heating element as a result of the value of the signal being less than a second threshold value, the first threshold value being greater than the second threshold value, the second relay stopping supply power to the second heating element as a result of the value of the signal being greater than a third threshold value, and the first relay stopping supply power to the first heating element as a result of the value of the signal being greater than a fourth threshold value, the fourth threshold value being greater than the third threshold value, and operating the first relay to supply power to the first heating element, and operating the second relay to supply power to the second heating element, basing the operation on the selected mode.

8. The water heater of claim 7, wherein operating the first relay to supply power to the first heating element includes operating the first relay as a result of the value of the signal being less than a first threshold value, and wherein operating the second relay to supply power to the second heating element includes operating the second relay as a result of the value of the signal being less than a second threshold value, the first threshold value being greater than the second threshold value.

9. The water heater of claim 7, wherein the controller includes further instructions for, in the one power cycle, operating the first relay to stop supply power to the first heating element as a result of the value of the signal being greater than a first threshold value, and operating the second relay to stop supply power to the second heating element as a result of the value of the signal being greater than a second threshold value, the second threshold value being greater than the first threshold value.

10. The water heater of claim 7, wherein the first relay is a first contactor and the second relay is a second contactor.

11. The water heater of claim 7, wherein the controller further includes instructions for, in the one heating cycle, operating one of the first relay and the second relay to supply power to the corresponding heating element, and thereafter, operating the other of the first relay and the second relay to supply power to the corresponding heating element, and in another heating cycle subsequent to the one heating cycle, operating the other of the first contactor and a second contactor relay to supply power to the corresponding second heating element, and thereafter, operating the one of a first contactor relay and the second contactor to supply power to the corresponding first heating element.

12. The water heater of claim 7, wherein the controller further includes instructions for selecting a linear sequencing mode wherein, in one heating cycle, the first relay to supply power to the first heating element as a result of the value of the signal being less than a first threshold value, the second relay to supply power to the second heating element as a result of the value of the signal being less than a second threshold value, the first threshold value being greater than the second threshold value, the first relay stopping supply power to the first heating element as a result of the value of the signal being greater than a third threshold value, and the second relay stopping supply power to the second heating element as a result of the value of the signal being greater than a fourth threshold value, the fourth threshold value being greater than the third threshold value.

13. A water heater comprising:

an apparatus for supporting a fluid;

a first heating element for manipulating a temperature of a fluid;

a first relay connected to the first heating element;

a second heating element for manipulating a temperature of a fluid;

a second relay connected to the second heating element;

a probe for generating a signal relating the temperature of the fluid; and a controller for selectively operating the first relay and the second relay, the controller having an electronic circuit and including instructions for, selecting a mode from at least, a linear sequencing mode, wherein, in one heating cycle, the first relay to supply power to the first heating element as a result of the value of the signal being less than a first threshold value, the second relay to supply power to the second heating element as a result of the value of the signal being less than a second threshold value, the first threshold value being greater than the second threshold value, the first relay stopping supply power to the first heating element as a result of the value of the signal being greater than a third threshold value, and the second relay stopping supply power to the second heating element as a result of the value of the signal being greater than a fourth threshold value, the fourth threshold value being greater than the third threshold value, and a progressive sequencing mode, wherein, in one heating cycle, the first relay to supply power to the first heating element as a result of the value of the signal being less than a first threshold value, the second relay to supply power to the second heating element as a result of the value of the signal being less than a second threshold value, the first threshold value being greater than the second threshold value, the second relay stopping supply power to the second heating element as a result of the value of the signal being greater than a third threshold value, and the first relay stopping supply power to the first heating element as a result of the value of the signal being greater than a fourth threshold value, the fourth threshold value being greater than the third threshold value, and operating the first relay to supply power to the first heating element, and operating the second relay to supply power to the second heating element, basing the operation on the selected mode.

14. The water heater of claim 13, wherein the first relay is a first contactor and the second relay is a second contactor.

15. The water heater of claim 13, wherein the controller further includes instructions for, in the one heating cycle, operating one of the first relay and the second relay to supply power to the corresponding heating element, and thereafter, operating the other of the first relay and the second relay to supply power to the corresponding heating element, and in another heating cycle subsequent to the one heating cycle, operating the other of the first contactor and a second contactor relay to supply power to the corresponding second heating element, and thereafter, operating the one of a first contactor relay and the second contactor to supply power to the corresponding first heating element.

16. The water heater of claim 13, wherein the controller contains further instructions for a no-sequencing mode, wherein the first and second relays are operated concurrently.

17. The water heater of claim 16, wherein operating the first relay to supply power to the first heating element includes operating the first relay as a result of the value of the signal being less than a first threshold value, and wherein operating the second relay to supply power to the second heating element includes operating the second relay as a result of the value of the signal being less than a second threshold value, the first threshold value being greater than the second threshold value.

18. The water heater of claim 16, wherein the controller includes further instructions for, in the one power cycle, operating the first relay to stop supply power to the first heating element as a result of the value of the signal being greater than a first threshold value, and operating the second relay to stop supply power to the second heating element as a result of the value of the signal being greater than a second threshold value, the second threshold value being greater than the first threshold value.

* * * * *